US006702271B1

(12) United States Patent
Nussbaum

(10) Patent No.: US 6,702,271 B1
(45) Date of Patent: Mar. 9, 2004

(54) PROFILE FRAMES

(75) Inventor: Bjoern Nussbaum, Osnabrueck (DE)

(73) Assignee: Solarlux Aluminium Systeme GmbH, Bissendorf (DE)

( * ) Notice: Subject to any disclaimer, the term of this patent is extended or adjusted under 35 U.S.C. 154(b) by 0 days.

(21) Appl. No.: 09/665,334

(22) Filed: Sep. 19, 2000

(30) Foreign Application Priority Data

Sep. 20, 1999 (DE) ..... 199 45 035
Jan. 20, 2000 (DE) ..... 100 02 075

(51) Int. Cl.[7] ..... B25B 1/06

(52) U.S. Cl. ..... 269/224; 269/254 R; 269/249; 269/274

(58) Field of Search ..... 269/254 R, 249, 269/274, 224

(56) References Cited

U.S. PATENT DOCUMENTS

| | | | | |
|---|---|---|---|---|
| 3,481,572 A | | 12/1969 | Casebolt et al. | |
| 3,744,186 A | | 7/1973 | Tantlinger | |
| 4,353,612 A | * | 10/1982 | Meyers | 339/95 R |
| 4,505,010 A | * | 3/1985 | Arenhold | 24/456 |
| 5,692,273 A | * | 12/1997 | Rodde | 24/541 |

FOREIGN PATENT DOCUMENTS

| | | |
|---|---|---|
| CA | 1167322 | 5/1984 |
| DE | 3900412 | 7/1990 |
| DE | 9312779 | 11/1993 |
| DE | 4335387 | 4/1995 |
| EP | 0209845 | 1/1987 |
| FR | 2699591 | 6/1994 |
| GB | 1049473 | 11/1966 |

* cited by examiner

*Primary Examiner*—Robert C. Watson
(74) *Attorney, Agent, or Firm*—Jordan and Hamburg LLP

(57) ABSTRACT

A profile frame (1) for holding plane elements (3) in an essentially U-shaped accommodating profile (2), the one leg of the U of which is constructed as a stopping leg (4) for the plane element (3) and the other leg of the U of which is constructed essentially parallel to the stopping leg (4) as a compressing leg (5) for clamping the plane element (3) between the two legs (4, 5), is distinguished owing to the fact that the compressing leg (5) has a clamping region (5) and a nominal deformation region (7), by the deformation of which the clamping region (6) can be pressed against the plane element (3). Preferably, a clamping element (10) can be connected with the accommodating profile (2), act on the clamping region (6) of the compressing leg (5) and presses the latter against the plane element (3). The clamping element (10) can be constructed to accommodate at least one fitting (16) or can be connected with a fitting (16).

34 Claims, 3 Drawing Sheets

PROFILE FRAMES

BACKGROUND OF THE INVENTION

Figure 1:
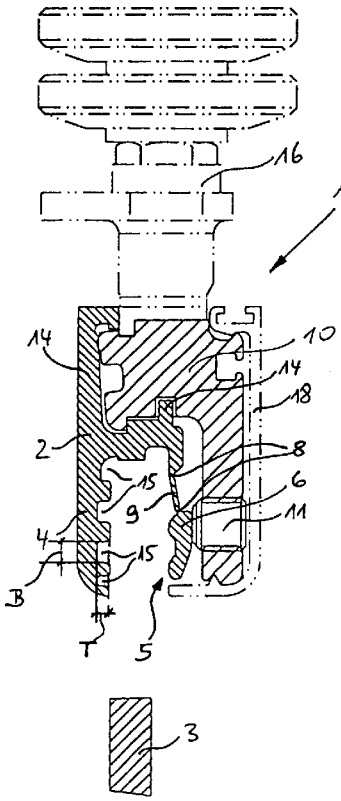

The invention relates to a profile frame for holding plane elements such as glass panes, plastic, wooden or metal plates, or similar plate-like elements.

Profile frames must absorb relatively high forces, particularly if the plane elements to be accommodated therein are not held at all edges, but rather solely on one side or on two opposing sides. In the profile frames used in practice, the plane elements are secured in part by bolts, which, however, require the presence in the plane elements of boreholes provided at predetermined locations. Alternatively or in addition thereto, the plane elements may be bonded into the profile frame, which however is detrimental to the extent that the profile frames cannot be processed further for a relatively long time after the plane elements are bonded into them, inasmuch as the bonding agents suitable for these applications cure very slowly. In addition, the two ways of fixation described above for securing plane elements in profile frames have the disadvantage that, in the case of plane elements of various thicknesses, one must provide different profile frames appropriately adjusted to them.

In DE 297 18 854 U1, there is therefore already a description of a profile frame, in which the legs of the profile frame that hold the plate element are constructed in two separate parts, which are telescoped or slide one into the other until they reach the thickness of the plane element, thus fixing the latter between them. These profile frames are suitable for accommodating plane elements of different thicknesses. However, they present the disadvantage that in each case two profile bars must be stored, shortened to the necessary length and, fitting accurately, inserted one into the other.

SUMMARY OF THE INVENTION

It is an object of the invention to provide a profile frame, which can be produced and stored economically and also makes it possible to provide in a simple manner a stable and secure mount for plane elements.

By designing the compressing leg with a nominal deformation region, whose deformation will cause a clamping region to press the plane element against the stopping leg and thus clamp it between the two legs, the accommodation in the profile frame of plane elements of different thicknesses is made possible, without having to construct the two legs, which extend at the side of the plane element, as separate parts of the profile frame. Depending on the thickness of the plane element, there occurs, in order to clamp the latter into the profile frame, a greater or lesser deformation of the nominal deforming region. This deformation can take place along the entire length of the profile frame, or only pointwise, and can be accomplished with the use of any desired tool. In so doing, the fastening of the plane element can be carried out solely by the clamping, or else the plane element can in addition be bonded. In the latter case the clamping between compressing leg and stopping leg alone suffices to fix the plane element in the profile frame and thus permits further transport and processing, as long as the bonding agent has not yet cured and cannot yet ensure a connection by adhesion between plane elements and the frame profile.

Preferably, the nominal deforming region is formed by a region, in which the compressing leg has a diminished material thickness, so that the deformation occurs in this region. Alternatively it would also be possible, for instance, to design the nominal deforming region without thinning it out, by using another material, more easily deformed than the rest of the profile frame; however, as a rule this causes higher fabrication costs. In order to achieve a controlled deformation at a defined spot of the compressing leg, the nominal deformation region has at least one designated buckling point, which may be constructed, for example, by introducing a notch.

Figure 2:
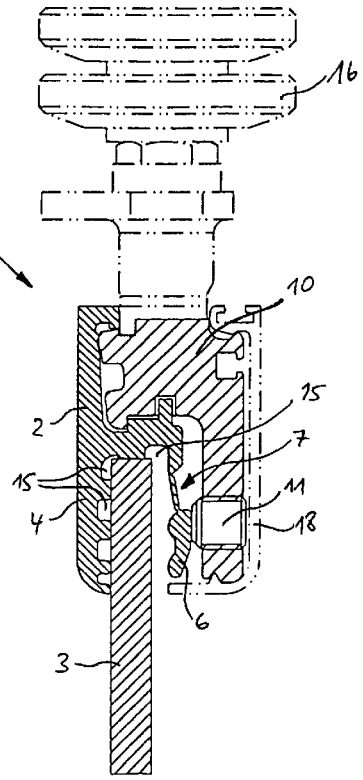
Figure 3:
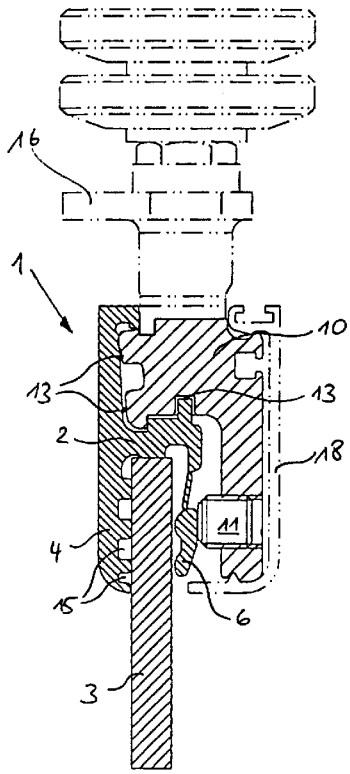
Figure 4:
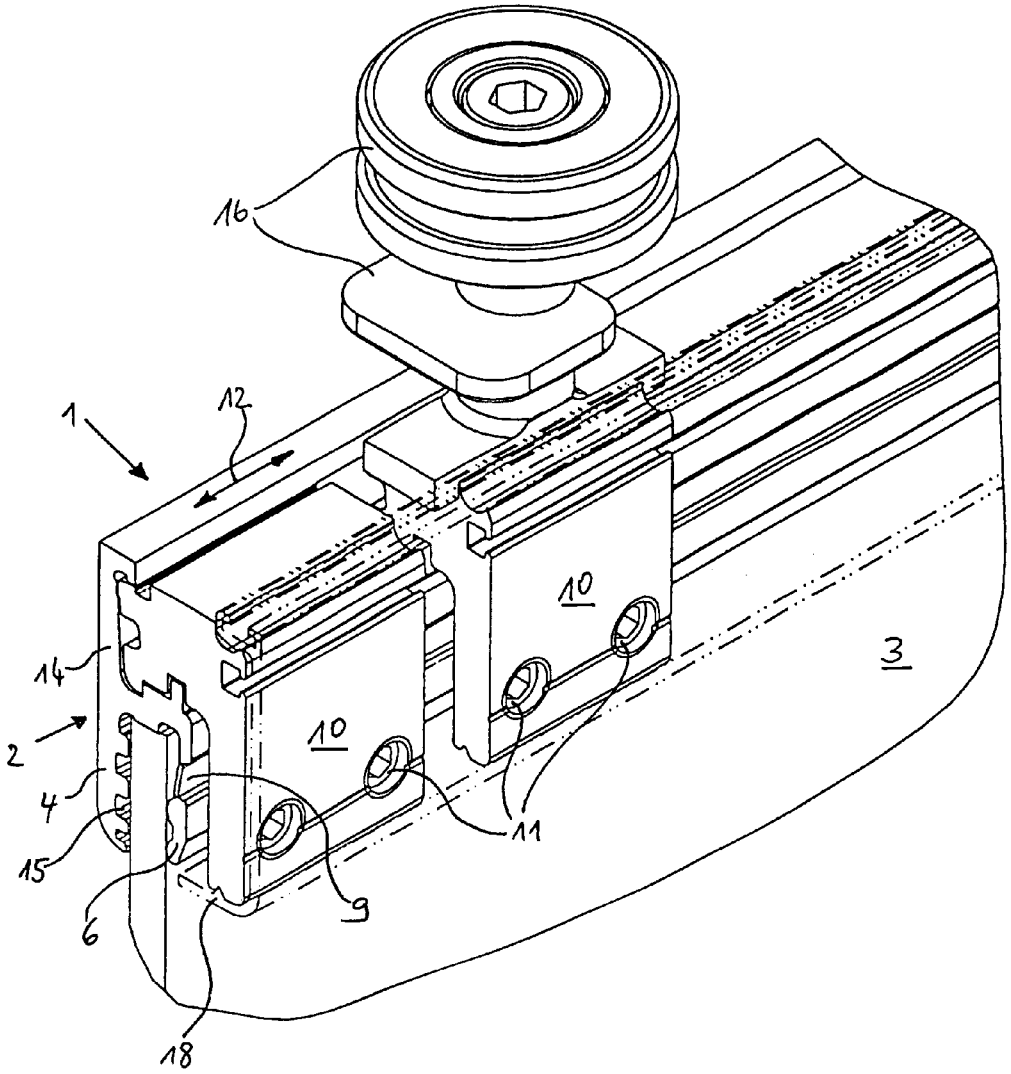
Figure 5:
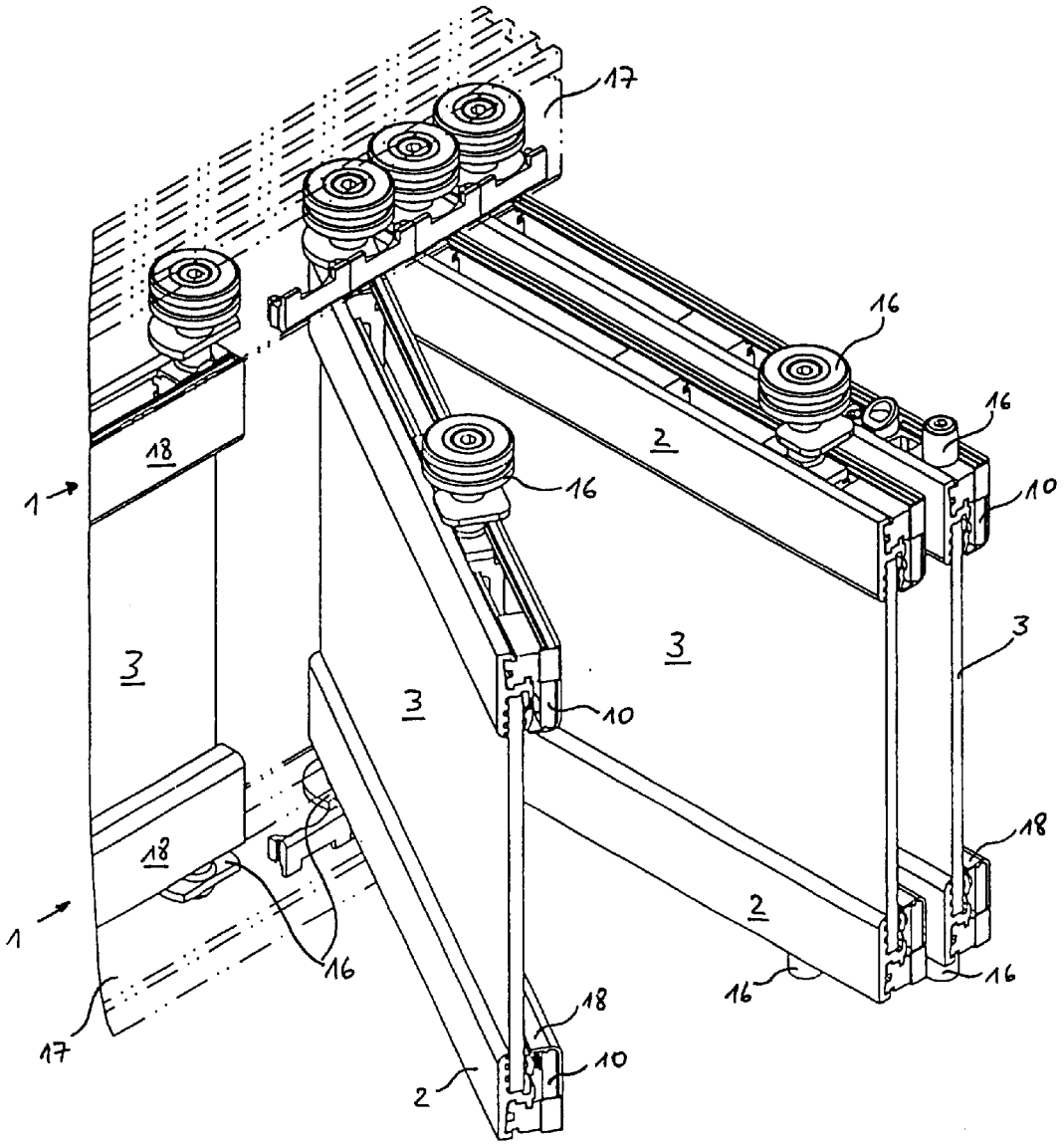

Further advantages and details are provided in the dependent claims and in the example of the invention, described in the following and shown in the accompanying drawings, FIG. 1 shows a cross-section of an inventive profile frame, before a plane element is accommodated, FIG. 2 shows the object of FIG. 1, with a plane element introduced into the accommodating profile, FIG. 3 shows the object of FIG. 2 during the clamping of the plane element, FIG. 4 shows a perspective representation of part of a profile frame with a plane element, and FIG. 5 shows inventive profile frames, when used in a sliding element arrangement.

DESCRIPTION OF THE PREFERRED EMBODIMENTS

The profile frame 1, shown in the FIGS. 1 to 3, has a U-shaped accommodating profile 2 for accommodating a plane element 3. One leg of the U of the accommodating profile 2 is constructed as a stopping leg 4, while the other leg of the U fulfills the function of a compressing leg 5. The latter has at its outer end a clamping region 6, which is connected over a nominal deformation region 7 with the rest of the accommodating profile 2. In the case of the embodiment shown, the nominal deformation region 7 is formed by two designated buckling points 8 with a material thickness, which is clearly reduced by notches, and by a bridge 9 connecting them. By these means, the clamping region 6, when pressed against the plane element 3, can be moved almost parallel to the latter, while the designated buckling points 8, in hinge-fashion, permit swiveling of the bridge 9. The accommodating profile 2, designed in this fashion, can be extruded preferably from aluminum, in one piece. Due to the fact that the accommodating profile 2 is wider in its bottom region than the plane element 3 that is to be held, plane elements 3 of different thicknesses or even those thickened or strengthened at the edges, can be accommodated.

The pressing of clamping region 6 against the plane element 3 can also be carried out by means of or several clamping elements 10, so that, in order to clamp the plane element 3, no additional tool is required. For this purpose, the clamping element 10 preferably comprises one or several screwing components such as threaded pins or screws, disposed at the level of the clamping region 6. In the case of the embodiment shown, the locking screws 11 are set screws, which, when rotated, can be screwed further into the clamping element 10 and thus press the clamping region 6 against the plane element 3, as can be seen in FIG. 3.

Admittedly, the clamping action of the clamping region 6 of the compressing leg 4 against the plane element 3 may be sufficient to hold the plane element 3. However, it is advantageous, particular in the case of heavy plane elements 3, such as glass, if the profile frame 1, as shown, has one or more clamping element 10, which will maintain the pressure on the clamping region 6 of the compressing leg 5, even after the actual deformation process of the nominal deformation region 7.

In order to be able to position the clamping elements 10 at any desired position of the profile frame 1, they are preferably held at the accommodating profile 2, displaceable in the longitudinal direction of the latter, as indicated in FIG. 4 by an arrow 12. In the case of the embodiment shown, this is brought about particularly easily from a production point of view and, nevertheless stably by tongue and groove connections 13, for which purpose the stopping leg 4 and the pressing leg 5 have extensions 14 on their upper side. In the case of the embodiment shown, locking screws 12, which not only press the locking region 6 against the plane element 3, but also fix the clamping element 10 itself to the accommodating profile 2, fix the clamping element 10 in the longitudinal direction 12 of the accommodating profile 2.

In addition to the clamped mount of the plane element 3 in the profile frame 1, the plane element 3 can be bonded to the latter, whereby the bonding agent, which is not shown in the Figures, may simultaneously function as insulation against penetrating moisture. In order to have sufficient storage and escape areas for the bonding agent, the accommodating profile 2 has recesses 15, preferably at the internal sides facing the plane element 3. These are constructed preferably as channels with a groove, which extend along the accommodating profile 2. This facilitates the introduction of the bonding agent and permits bonding agent to be injected in the case of a previously inserted plane element 3.

Since accommodating profiles 2 of aluminum and plane elements 3 of glass, for example, have greatly different coefficients of expansion, the bonding agent must absorb large shearing forces in the event of temperature fluctuations. In such cases, tearing of the bonding agent can be prevented owing to the fact that the recesses 15 are sufficiently deep, so that the bonding agent, contained in them, elastically compensates for the displacements between the accommodating profile 2 and the plane element 3. For this purpose, the dimensions of the recess 15 should preferably be selected so that the depth T of the recess is equal to at least ⅔ of its width B. Preferably, the depth T of the recesses 15 should is at least 1 mm or, better yet, 1.5 mm or more.

The inventive profile frames 1 are suitable particularly for accommodating plane elements 3 in so-called sliding or gliding systems, such as those used for glassed-in terraces, or for partitions, room dividers, shading devices or the like. Such a glassed-in terrace system is shown in part in FIG. 5. In that case, the plane elements 3, held in the profile frames 1, are guided movably and pivotably in guide rails 17 over roller devices, guide pins, etc., which are referred to collectively as fittings 16. Since the fittings 16 must be connected with the profile frame 1, the clamping elements 10 can advantageously be constructed to accommodate the fittings 16, by having appropriate boreholes, threaded boreholes, grooves, cut-outs or the like for connection with the fittings 16. The fittings 16 can also be connected solidly, that is, in one piece, with the clamping elements 10. By means of a displaceable arrangement of the clamping elements 10 at the accommodating profile 2, a variable positioning of the fittings 16 along the profile frame 1, which facilitates the construction and adjustment of the sliding system, is then possible in an ideal manner. By means of the locking screws 11, a loosening, shifting and renewed fixing of the clamping elements 10, is then also possible in an advantageous manner, if it should become necessary to adjust the position of these clamping elements along the accommodating profile 2.

Finally, the clamping elements 10 can serve to accommodate a cover profile 18, which lies opposite the stopping leg 4 and protects the profile frame 1 against contamination by dirt or other external effects and visually enhances the system. In the case of the embodiment shown, the clamping elements 10 are designed so that they accommodate the cover profile 18, shown by lines of dots and dashes in FIGS. 1 to 4, locking it in place.

To sum up, the, inventive profile frame 1 offers a high degree of flexibility with respect to its application possibilities, can be manufactured cost effectively, is easily installed and has a high stability. It can encompass the plane element, which is to be accommodated, on all its sides, or be attached to only one, two, or three edges.

What is claimed is:

1. A profile frame for a plane element, the profile frame comprising a substantially U-shaped device having a stopping leg spaced from and connected to a compressing leg, said plane element being adapted to being received in the space between said stopping leg and said compressing leg, said compressing leg including a deformation region connecting a clamping region to said stopping leg, and a clamping device having the stopping leg rigidly extend therefrom and the clamping device being operable to displace said clamping region relative to said deformation region and toward said stopping leg to thereby clamp the plane element between said stopping leg and said clamping region, wherein said deformation region is thinner than said clamping region.

2. A profile frame for a plane element, the profile frame comprising a substantially U-shaped device having a stopping leg spaced from and connected to a compressing leg, said plane element being adapted to being received in the space between said stopping leg and said compressing leg, said compressing leg including a deformation region connecting a clamping region to said stopping leg, and a clamping device having the stopping leg rigidly extend therefrom and the clamping device being operable to displace said clamping region relative to said deformation region and toward said stopping leg to thereby clamp the plane element between said stopping leg and said clamping region, wherein said deformation region has at least one buckling portion which is thinner than said clamping region, said buckling portion being operable to flex when said clamping device displaces said clamping region relative to said deformation region.

3. A profile frame for a plane element, the profile frame comprising a substantially U-shaped device having a stopping leg spaced from a compressing leg, said plane element being adapted to being received in the space between said stopping leg and said compressing leg, said compressing leg including a deformation region and a clamping region, said deformation region being connected to said clamping region, and a clamping device operable to displace said clamping region relative to said deformation region and toward said stopping leg to thereby clamp the plane element between said stopping leg and said clamping region, wherein said deformation region has at least two buckling portions and one bridge portion, said bridge portion being connected between said at least two buckling portions.

4. The profile frame according to claim 1, wherein said clamping device comprises at least one clamping part supported on said U-shaped device and at least one clamping element moveable mounted on said at least one clamping part and operable to press said clamping region of said U-shaped device against said plant element.

5. The profile frame according to claim 4, wherein said at least one clamping element includes at least one fastening element.

6. The profile frame according to claim 5, wherein said at least one fastening element is a locking screw threaded to said clamping part.

7. The profile claim according to claim 5 wherein said U-shaped device and said clamping part include mounting portions mounting said U-shaped device on said clamping part, said fastening element being operable to secure said U-shaped device to said clamping part.

8. The profile frame according to claim 1 wherein said U-shaped device is elongated and said clamping device is elongated, said U-shaped device and said clamping device including mounting portions slidable mounting said U-shaped device on said clamping device.

9. A profile frame for a plane element, the profile frame comprising a substantially U-shaped device having a stopping leg spaced from a compressing leg, said plane element being adapted to being received in the space between said stopping leg and said compressing leg, said compressing leg including a deformation region and a clamping region, said deformation region being connected to said clamping region, and a clamping device operable to displace said clamping region relative to said deformation region and toward said stopping leg to thereby clamp the plane element between said stopping leg and said clamping region, wherein at least one of said U-shaped device and said clamping device has a tongue and the other of said U-shaped device and said clamping device has a groove which receives said tongue.

10. The profile frame according to claim 1 wherein the profile frame is adapted to be supported on a support structure, said clamping device including a fitting for movable mounting the profile frame on the support structure.

11. A profile frame for a plane element, the profile frame comprising a substantially U-shaped device having a stopping leg spaced from a compressing leg, said plane element being adapted to being received in the space between said stopping leg and said compressing leg, said compressing leg including a deformation region and a clamping region, said deformation region being connected to said clamping region, a clamping device operable to displace said clamping region relative to said deformation region and toward said stopping leg to thereby clamp the plane element between said stopping leg and said clamping region, and a cover mounted on said clamping device.

12. A profile frame for a plane element, the profile frame comprising a substantially U-shaped device having a stopping leg spaced from a compressing leg, said plane element being adapted to being received in the space between said stopping leg and said compressing leg, said compressing leg including a deformation region and a clamping region, said deformation region being connected to said clamping region, and a clamping device operable to displace said clamping region relative to said deformation region and toward said stopping leg to thereby clamp the plane element between said stopping leg and said clamping region, wherein one of said stopping leg and said compressing leg has at least one recess, and a bounding agent in said at least one recess.

13. The profile frame according to claim 12, wherein said at least one recess is an elongated groove.

14. The profile frame according to claim 12, wherein said at least one recess has a depth and a width, said depth is being two-thirds of said width.

15. The profile frame according to claim 12, wherein said at least one recess has a depth of at least 1 mm.

16. A profile frame for a plane element, the profile frame comprising a substantially U-shaped device having a stopping leg spaced from a compressing leg, said plane element being adapted to being received in the space between said stopping leg and said compressing leg, said compressing leg including a deformation region and a clamping region, said deformation region being connected to said clamping region, and a clamping device operable to displace said clamping region relative to said deformation region and toward said stopping leg to thereby clamp the plane element between said stopping leg and said clamping region, wherein said deformation region includes an outer surface and a buckling notch extending inwardly of said outer surface.

17. A profile frame according to claim 1 wherein said clamping region of said compressing leg has a generally flat surface, said plane element having a planer surface, said flat surface of said clamping region being maintained generally parallel to said planar surface of said plane element as said clamping device displaces said clamping region relative to said deformation region.

18. A profile frame according to claim 1 wherein said U-shaped device is an elongated element having a substantially constant cross sectional configuration along its elongated extent.

19. A profile frame according to claim 1 wherein said U-shaped device is a single piece of extruded metal.

20. A profile frame according to claim 1 wherein said clamping device is an elongated extruded element having a substantially constant cross sectional configuration along its elongate extent.

21. A profile frame for a plane element, the profile frame comprising a U-shaped part and a clamping part, said U-shaped part and said clamping part include mounting portions mounting said U-shaped part on said clamping part, said U-shaped part including a stopping leg spaced from and connected to a compressing leg, said plane element being adapted to being received in the space between said stopping leg and said compressing leg, said compressing leg including a deformation region connecting a clamping region to said stopping leg, and a clamping element having the stopping leg rigidly extend therefrom, the clamping element moveably mounted on said clamping part and operable to displace said clamping region relative to said deformation region and toward said stopping leg to thereby clamp the plane element between said stopping leg and said clamping region.

22. A profile frame for a plane element, the profile frame comprising a U-shaped part and a clamping part, said U-shaped part and said clamping part include mounting portions mounting said U-shaped part on said clamping part, said U-shaped part including a stopping leg spaced from a compressing leg, said plane element being adapted to being received in the space between said stopping leg and said compressing leg, said compressing leg including a deformation region and a clamping region, said deformation region being connected to said clamping region, and a clamping element moveably mounted on said clamping part and operable to displace said clamping region relative to said deformation region and toward said stopping leg to thereby clamp the plane element between said stopping leg and said clamping region, wherein said one clamping element is a fastening element which is operable to secure said U-shaped part on said clamping part.

23. A profile frame for a plane element, the profile frame comprising a substantially U-shaped device having a stopping leg spaced from and connected to a compressing leg, said plane element being adapted to being received in the space between said stopping leg and said compressing leg, said compressing leg including a deformation region connecting a clamping region to said stopping leg and a clamping device having the stopping leg rigidly extend therefrom and the clamping device being operable to displace said clamping region relative to said deformation region and toward said stopping leg to thereby clamp the plane element between said stopping leg and said clamping region, wherein the U-shaped device extends substantially over a complete length of a longitudinal edge of the plane element, wherein said deformation region is thinner than said clamping region.

24. A profile frame for a plane element, the profile frame comprising a substantially U-shaped device having a stopping leg spaced from and connected to a compressing leg, said plane element being adapted to being received in the space between said stopping leg and said compressing leg, said compressing leg including a deformation region connecting a clamping region to said stopping leg and a clamping device having the stopping leg rigidly extend therefrom and the clamping device being operable to displace said clamping region relative to said deformation region and toward said stopping leg to thereby clamp the plane element between said stopping leg and said clamping region, wherein the U-shaped device extends substantially over a complete length of a longitudinal edge of the plane element, wherein said deformation region has at least one buckling portion which is thinner than said clamping region, said buckling portion being operable to flex when said clamping device displaces said clamping region relative to said deformation region.

25. A profile frame for a plane element, the profile frame comprising a substantially U-shaped device having a stopping leg spaced from and connected to a compressing leg, said plane element being adapted to being received in the space between said stopping leg and said compressing leg, said compressing leg including a deformation region connecting a clamping region to said stopping leg and a clamping device having the stopping leg rigidly extend therefrom and the clamping device being operable to displace said clamping region relative to said deformation region and toward said stopping leg to thereby clamp the plane element between said stopping leg and said clamping region, wherein the U-shaped device extends substantially over a complete length of a longitudinal edge of the plane element, wherein said deformation region has at least two buckling portions and one bridge portion, said bridge portion being connected between said at least two buckling portions.

26. A profile frame for a plane element, the profile frame comprising a substantially U-shaped device having stopping leg spaced from and connected to a compressing leg, said plane element being adapted to being received in the space between said stopping leg and said compressing leg, said compressing leg including a deformation region connecting a clamping region to said stopping leg and a clamping device having the stopping leg rigidly extend therefrom and the clamping device being operable to displace said clamping region relative to said deformation region and toward said stopping leg to thereby clamp the plane element between said stopping leg and said clamping region, wherein the U-shaped device extends substantially over a complete length of a longitudinal edge of the plane element, wherein:

said clamping device comprises at least one clamping part supported on said U-shaped device and at least one clamping element moveable mounted on said at least one clamping part and operable to press said clamping region of said U-shaped device against said plane element;

wherein said at least one clamping element includes at least one fastening element; and wherein said at least one fastening element is a locking screw threaded to said clamping part.

27. A profile frame for a plane element, the profile frame comprising a substantially U-shaped device having a stopping leg spaced from and connected to a compressing leg, said plane element being adapted to being received in the space between said stopping leg and said compressing leg, said compressing leg including a deformation region connecting a clamping region to said stopping leg and a clamping device having the stopping leg rigidly extend therefrom and the clamping device being operable to displace said clamping region relative to said deformation region and toward said stopping leg to thereby clamp the plane element between said stopping leg and said clamping region, wherein the U-shaped device extends substantially over a complete length of a longitudinal edge of the plane element, wherein at least one of said U-shaped device and said clamping device has a tongue and the other of said U-shaped device and said clamping device has a groove which receives said tongue.

28. A profile frame for a plane element, the profile frame comprising a substantially U-shaped device having a stopping leg spaced from and connected to a compressing leg, said plane element being adapted to being received in the space between said stopping leg and said compressing leg, said compressing leg including a deformation region connecting a clamping region to said stopping leg and a clamping device having the stopping leg rigidly extend therefrom and the clamping device being operable to displace said clamping region relative to said deformation region and toward said stopping leg to thereby clamp the plane element between said stopping leg and said clamping region, wherein the U-shaped device extends substantially over a complete length of a longitudinal edge of the plane element, wherein the profile frame is adapted to be supported on a support structure, said clamping device including a fitting for movable mounting the profile frame on the support structure.

29. A profile frame for a plane element, the profile frame comprising a substantially U-shaped device having a stopping leg spaced from and connected to a compressing leg, said plane element being adapted to being received in the space between said stopping leg and said compressing leg, said compressing leg including a deformation region connecting a clamping region to said stopping leg and a clamping device having the stopping leg rigidly extend therefrom and the clamping device being operable to displace said clamping region relative to said deformation region and toward said stopping leg to thereby clamp the plane element between said stopping leg and said clamping region, wherein the U-shaped device extends substantially over a complete length of a longitudinal edge of the plane element, and the profile frame further comprising a cover mounted on said clamping device.

30. A profile frame for a plane element, the profile frame comprising a substantially U-shaped device having a stopping leg spaced from and connected to a compressing leg, said plane element being adapted to being received in the space between said stopping leg and said compressing leg, said compressing leg including a deformation region connecting a clamping region to said stopping leg and a clamping device having the stopping leg rigidly extend therefrom and the clamping device being operable to displace said clamping region relative to said deformation region and toward said stopping leg to thereby clamp the plane element between said stopping leg and said clamping region, wherein the U-shaped device extends substantially over a complete length of a longitudinal edge of the plane element, wherein one of said stopping leg and said compressing leg has at least one recess, and a bounding agent in said at least one recess.

31. The profile frame according to claim 30, wherein said at least one recess is an elongated groove.

32. The profile frame according to claim 30, wherein said at least one recess has a depth and a width, said depth is being two-thirds of said width.

33. The profile frame according to claim 30, wherein said at least one recess has a depth of at least 1 mm.

34. A profile frame for a plane element, the profile frame comprising a substantially U-shaped device having a stopping leg spaced from and connected to a compressing leg, said plane element being adapted to being received in the space between said stopping leg and said compressing leg, said compressing leg including a deformation region connecting a clamping region to said stopping leg and a clamping device having the stopping leg rigidly extend therefrom and the clamping device being operable to displace said clamping region relative to said deformation region and toward said stopping leg to thereby clamp the plane element between said stopping leg and said clamping region, wherein the U-shaped device extends substantially over a complete length of a longitudinal edge of the plane element, wherein said deformation region includes an outer surface and a buckling notch extending inwardly of said outer surface.

* * * * *